US010644429B2

(12) United States Patent
Masada et al.

(10) Patent No.: US 10,644,429 B2
(45) Date of Patent: May 5, 2020

(54) CONNECTOR ASSEMBLY

(71) Applicant: J.S.T. Mfg. Co., Ltd., Tokyo (JP)

(72) Inventors: Shinya Masada, Yokohama (JP); Saki Katsumoto, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 16/238,039

(22) Filed: Jan. 2, 2019

(65) Prior Publication Data

US 2019/0260149 A1 Aug. 22, 2019

(30) Foreign Application Priority Data

Feb. 19, 2018 (JP) ..... 2018-027124

(51) Int. Cl.

| | |
|---|---|
| ***H01R 13/42*** | (2006.01) |
| ***H01R 13/436*** | (2006.01) |
| ***H01R 13/629*** | (2006.01) |
| ***H01R 13/518*** | (2006.01) |
| ***H01R 13/502*** | (2006.01) |
| ***H01R 13/11*** | (2006.01) |

(52) U.S. Cl.
CPC ..... *H01R 13/4362* (2013.01); *H01R 13/11* (2013.01); *H01R 13/502* (2013.01); *H01R 13/518* (2013.01); *H01R 13/629* (2013.01)

(58) Field of Classification Search
CPC ... H01R 13/4362; H01R 13/11; H01R 13/502
USPC ..... 439/572
See application file for complete search history.

(56) References Cited

U.S. PATENT DOCUMENTS

| | | | | |
|---|---|---|---|---|
| 5,839,923 | A * | 11/1998 | Yoshida | H01R 13/4362 439/752 |
| 6,390,859 | B2 * | 5/2002 | Furutani | H01R 13/4362 439/752 |
| 6,592,411 | B2 * | 7/2003 | Mase | H01R 13/4362 439/595 |
| 6,648,699 | B1 * | 11/2003 | Makino | H01R 13/4362 439/595 |
| 6,655,999 | B2 * | 12/2003 | Mase | H01R 13/4223 439/595 |
| 6,902,443 | B2 * | 6/2005 | Hara | H01R 13/4362 439/752 |
| 7,063,577 | B2 * | 6/2006 | Fujita | H01R 13/4223 439/701 |

(Continued)

FOREIGN PATENT DOCUMENTS

JP 2003-197300 A 7/2003

*Primary Examiner* — Alexander Gilman
(74) *Attorney, Agent, or Firm* — Kratz, Quintos & Hanson, LLP

(57) ABSTRACT

A connector assembly includes a housing which includes a box portion storing path to store a box portion formed in a vertically or horizontally asymmetric shape and a slot formed perpendicular to an extending direction of a box storing path and a retainer which includes a box portion opening to which the box portion is inserted in a case where the retainer is inserted into the slot and located at a temporary locking position. When a terminal is inserted into the box portion storing path from the box portion opening, the box portion opening is shaped to prevent the insertion when the terminal is rotated about the insertion axis of the terminal from an appropriate position.

5 Claims, 10 Drawing Sheets

(56) References Cited

U.S. PATENT DOCUMENTS

| | | | | |
|---|---|---|---|---|
| 7,195,522 | B2 * | 3/2007 | Okada | H01R 13/4362 439/752 |
| 7,204,725 | B2 * | 4/2007 | Yamashita | H01R 13/4362 439/752 |
| 7,445,524 | B2 * | 11/2008 | Horiuchi | H01R 13/4361 439/752 |
| 7,618,274 | B2 * | 11/2009 | Nakamura | H01R 13/641 439/188 |
| 8,215,984 | B2 * | 7/2012 | Yokozeki | H01R 13/506 439/540.1 |
| 8,894,450 | B2 * | 11/2014 | Kitajima | H01R 13/4362 439/752 |
| 9,673,553 | B1 * | 6/2017 | Upson | H01R 13/426 |

* cited by examiner

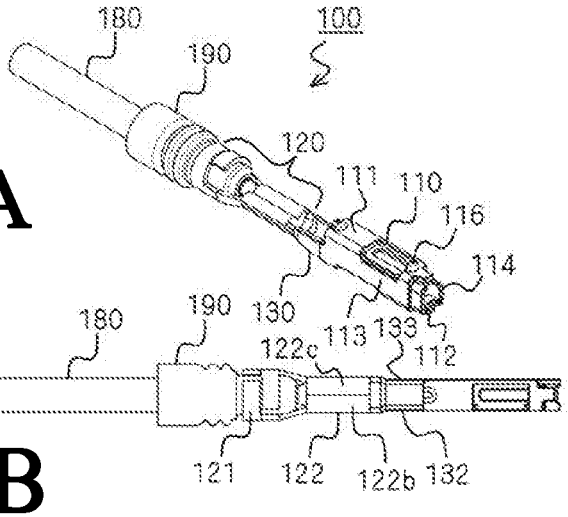
FIG. 2A
FIG. 2B
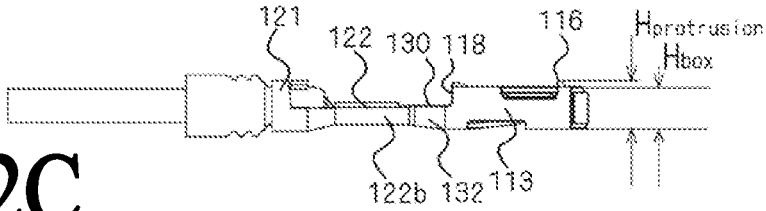
FIG. 2C
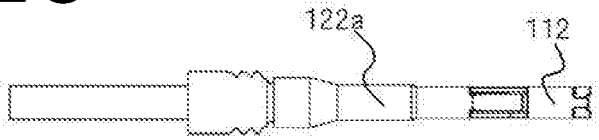
FIG. 2D
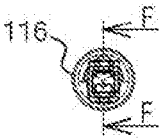
FIG. 2E
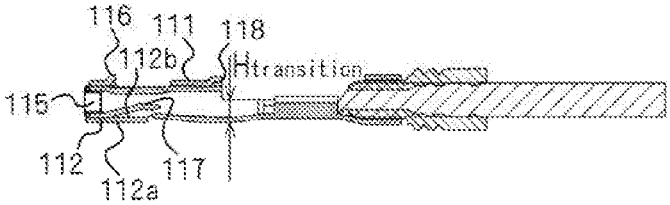
FIG. 2F

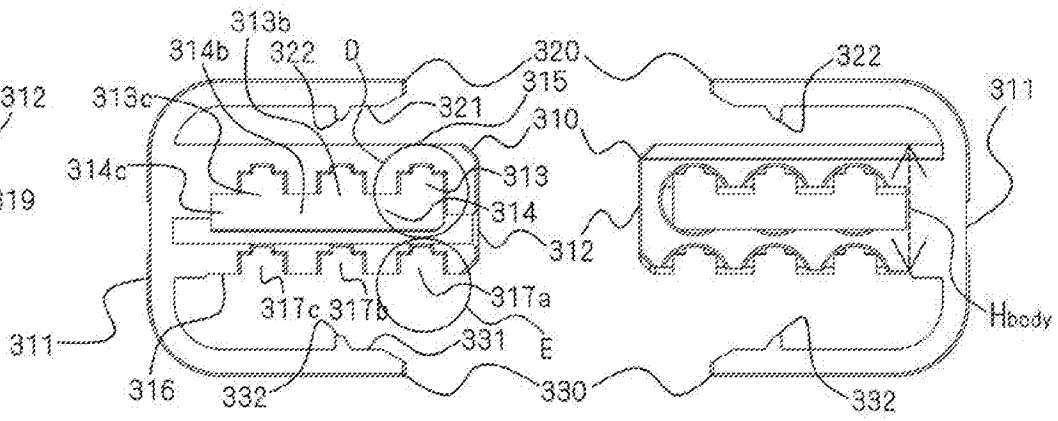
FIG. 4B
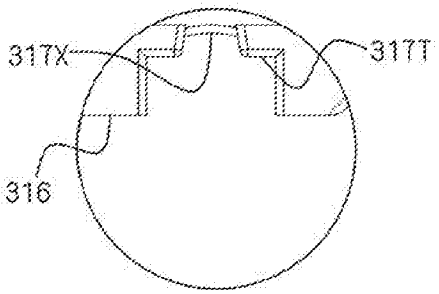
FIG. 4E
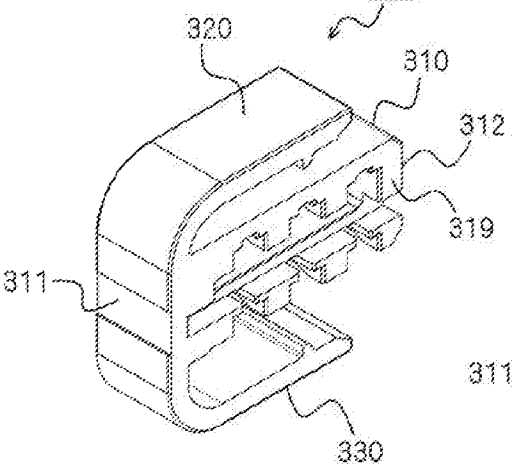
FIG. 4A
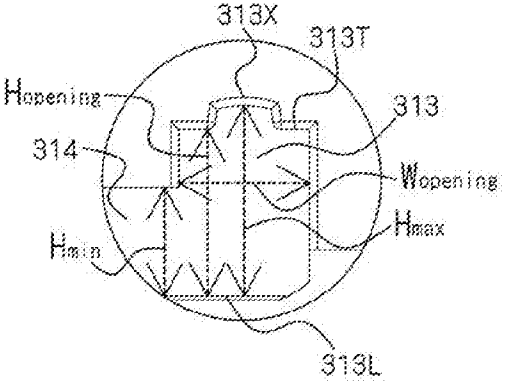
FIG. 4D
FIG. 4C FIG. 6A
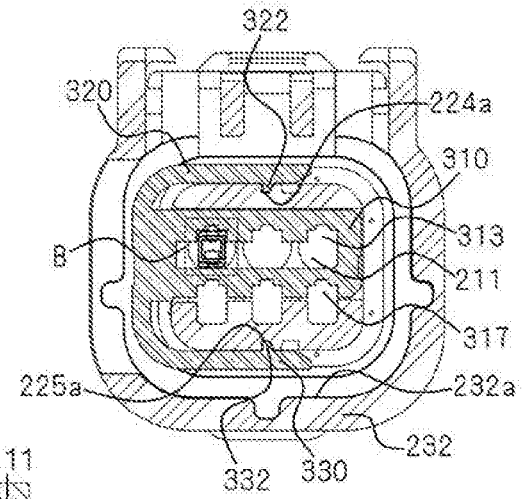
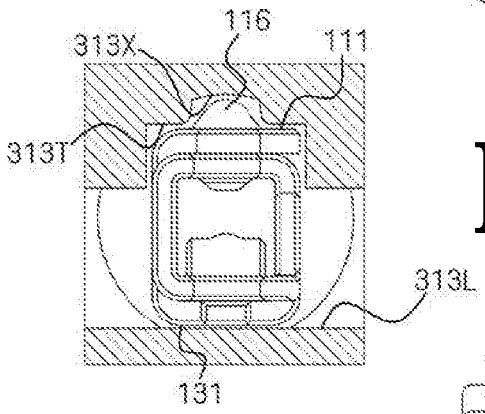
FIG. 6B
FIG. 6C
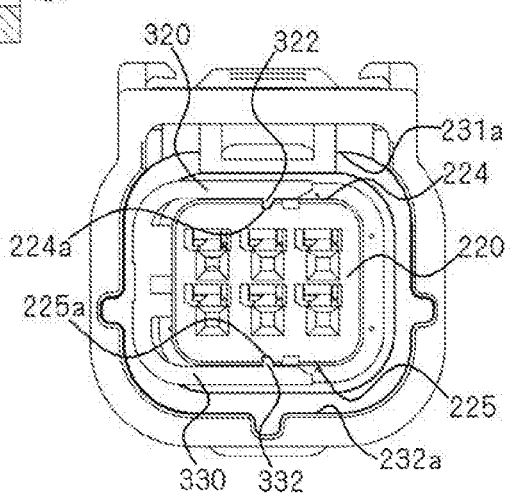

CONNECTOR ASSEMBLY

BACKGROUND

Technical Field

The present invention relates to a connector assembly, and particularly to a connector assembly which includes a retainer to prevent or avoid an inaccurate connection of a terminal mounted in a housing of the connector assembly.

Related Art

Conventionally, there is known an assembly in which a retainer is assembled in a connector housing in order to confirm that a terminal is correctly mounted in the connector housing and to prevent the terminal from falling off the connector housing after mounting in a case where the terminal connected to a lead wire is mounted in the connector housing. When the retainer is assembled to the connector housing, and located at a temporary locking position, the terminal can be inserted into the connector housing. Only when the terminal is completely mounted in the connector housing, the retainer can be moved to a final locking position. Then, when the retainer is located at the final locking position, the terminal is configured not to be pulled out of the connector housing.

JP 2003-197300 A discloses a connector in which a locking projection locked to a locked portion of a terminal metal fitting is provided in the retainer mounted in the connector housing, and a root on a rear side of the locking projection is made as a vertical surface and a tip end is made as a tapered surface. According to the connector, in a case where the retainer is at the temporary locking position and the terminal metal fitting is regularly inserted, the insertion is made while guiding the posture of the terminal metal fitting correctly along the tapered surface even when the posture is swung. On the other hand, in a case where the terminal metal fitting is inserted in a state where the retainer is pressed at an incorrect final locking position, the vertical surface abuts on a front surface or the locked portion of the terminal metal fitting. Therefore, an excessive pressing is restricted, so that the terminal metal fitting is prevented from being deformed.

SUMMARY

However, the connector disclosed in JP 2003-197300 A fails to disclose that the terminal metal fitting is prevented from being erroneously inserted in a case where the terminal metal fitting is inserted in a direction vertically-reversed from the regular posture or in a direction rotated by 90 degrees about an insertion axis.

Therefore, an object of the present invention is to provide a connector assembly which can prevent a terminal from being erroneously inserted in a state where the terminal is rotated about the insertion axis from an appropriate position.

According to one aspect of the present invention, there is provided a connector assembly, including:

a terminal which includes a box portion of which at least a cross-sectional shape is partially in a vertically or horizontally asymmetrical shape to receive a mating contact therein;

a housing which includes a box portion storing path to store the box portion and a slot formed to be perpendicular to an extending direction of the box portion storing path; and a retainer which includes a box portion opening and allows the box portion to pass through in a case where the retainer is inserted into the slot and is at a predetermined position in the slot, wherein the box portion opening is formed, when the terminal is inserted into the box portion storing path of the housing from the box portion opening of the retainer, to be a shape to prevent the insertion when the terminal is rotated about an insertion axis of the terminal from an appropriate position.

Furthermore, according to one aspect of the present invention, in the above aspect of the present invention, the box portion opening of the retainer is in a shape corresponding to a cross-sectional shape of the box portion of the vertically or horizontally asymmetric shape, and when the terminal is inserted into the box portion storing path of the housing from the box portion opening of the retainer, and when the terminal is rotated about the insertion axis of the terminal from an appropriate position, a cross-sectional shape of the box portion of the terminal and a shape of the box portion opening are not matched, and the insertion is prevented.

Furthermore, according to one aspect of the present invention, in the above aspect of the present invention, a projection protruding toward an outer side is provided in one surface of the box portion, and a surface facing the surface where the projection is provided is a flat shape, and one side of the box portion opening of the retainer is in a recessed shape to receive the projection, and a side facing the one side is in a flat shape.

Furthermore, according to one aspect of the present invention, in the above aspect of the present invention, the terminal includes a transition portion in a rear portion in an insertion direction of the terminal, the transition portion having a cross-sectional shape smaller than a cross-sectional shape of the box portion, the retainer includes a transition portion opening which is connected to the box portion opening, the transition portion opening in a direction perpendicular to an insertion direction of the retainer being smaller than the box portion opening, when the retainer is at the predetermined position in the slot at which the box portion opening and the box portion storing path are on a straight line, and the terminal takes an appropriate posture about the insertion axis, the terminal is able to be inserted into the box portion storing path from a crimping portion storing path through the box portion opening, and when the retainer is moved from the predetermined position to a final locking position, the transition portion of the terminal is stored in the transition portion opening, and the box portion is not removed.

Furthermore, according to one of the present invention, in the above aspect of the present invention, in the housing, a plurality of the box portion storing paths are disposed in the insertion direction of the retainer, in the retainer, the box portion opening and the transition portion opening are formed by the same number of box portion storing paths in the insertion direction of the retainer formed in the housing in the insertion direction, and each box portion opening is connected to the transition portion opening to receive the transition portion of an adjacent another terminal.

According to the above aspect of the present invention, in a case where the terminal is inserted into the box portion storing path of the housing from the box portion opening of the retainer in a state where the terminal is rotated from an appropriate position about the insertion axis, the box portion is prevented from being inserted by the box portion opening of the retainer, and an erroneous insertion in a state where the terminal is rotated from an appropriate position about the insertion axis can be prevented.

According to the above aspect of the present invention, in a case where the terminal is inserted into the box portion storing path of the housing from the box portion opening of the retainer in a state where the terminal is rotated from an appropriate position about the insertion axis, the shape of the box portion opening of the retainer is not matched with the shape of the box portion of the terminal, the insertion of the box portion is prevented, and the erroneous insertion in a state where the terminal is rotated from an appropriate position about the insertion axis can be prevented.

According to the above aspect of the present invention, when the terminal is inserted into the box portion storing path reversed by about 180 degrees about the insertion axis from an appropriate direction, a flat portion facing the projection of the box portion abuts on both portions of the recessed shape of the box portion opening of the retainer, and the insertion into the box portion storing path of the terminal is prevented.

In addition, according to the above aspect of the present invention, in a case where the box portion of the terminal is inserted into the box portion opening of the housing, and the retainer is moved from a predetermined position (temporary locking position) to the final locking position, the box portion of the terminal is stopped by a wall surface surrounding the transition portion opening of the retainer, so that the box portion can be prevented from being pulled out.

In addition, according to the above aspect of the present invention, a plurality of terminals can be arranged and stored in an insertion direction of the retainer in the housing. It is possible to prevent that each terminal is erroneously inserted in a state where the terminal is rotated from an appropriate position about the insertion axis. In addition, in a case where a structure against an erroneous insertion is formed in the housing, a mold for forming the housing becomes complicated. In a case where a structure against an erroneous insertion is formed in the retainer, the structure can be made easily compared to a case where the structure having the similar effect is formed in the housing.

BRIEF DESCRIPTION OF DRAWINGS

FIG. 2A is a perspective view of a terminal of the connector assembly in this embodiment;

FIG. 2B is a top view of the terminal of FIG. 2A;

FIG. 2C is a left side view when the terminal of FIG. 2A is viewed from the left side;

FIG. 2D is a bottom view of the terminal of FIG. 2A;

FIG. 2E is a front view of the terminal of FIG. 2A;

FIG. 2F is a cross-sectional view taken along line F-F in FIG. 2E;

FIG. 4A is a perspective view of a retainer of the connector assembly of this embodiment;

FIG. 4B is a front view of the retainer of FIG. 4A;

FIG. 4C is a rear view of the retainer of FIG. 4A;

FIG. 4D is an enlarged view of D portion of FIG. 4B;

FIG. 4E is an enlarged view of E portion of FIG. 4B;

FIG. 6A is a cross-sectional view taken in a Y-Z plane in FIG. 3A in a case where the retainer of the connector assembly in this embodiment is at a temporary locking position;

FIG. 6B is an enlarged view of B portion in FIG. 6A;

FIG. 6C is a front view in a case where the retainer of the connector assembly in this embodiment is at the temporary locking position;

DETAILED DESCRIPTION

Hereinafter, a connector assembly 10 of this embodiment will be described with reference to the drawings. Further, the embodiments described below are given as mere example of the connector assembly 10 of the present invention. However, the present invention is not limited to the connector assembly, and shall be applied even to other types of connector assembly within the scope of claims.

Figure 1:
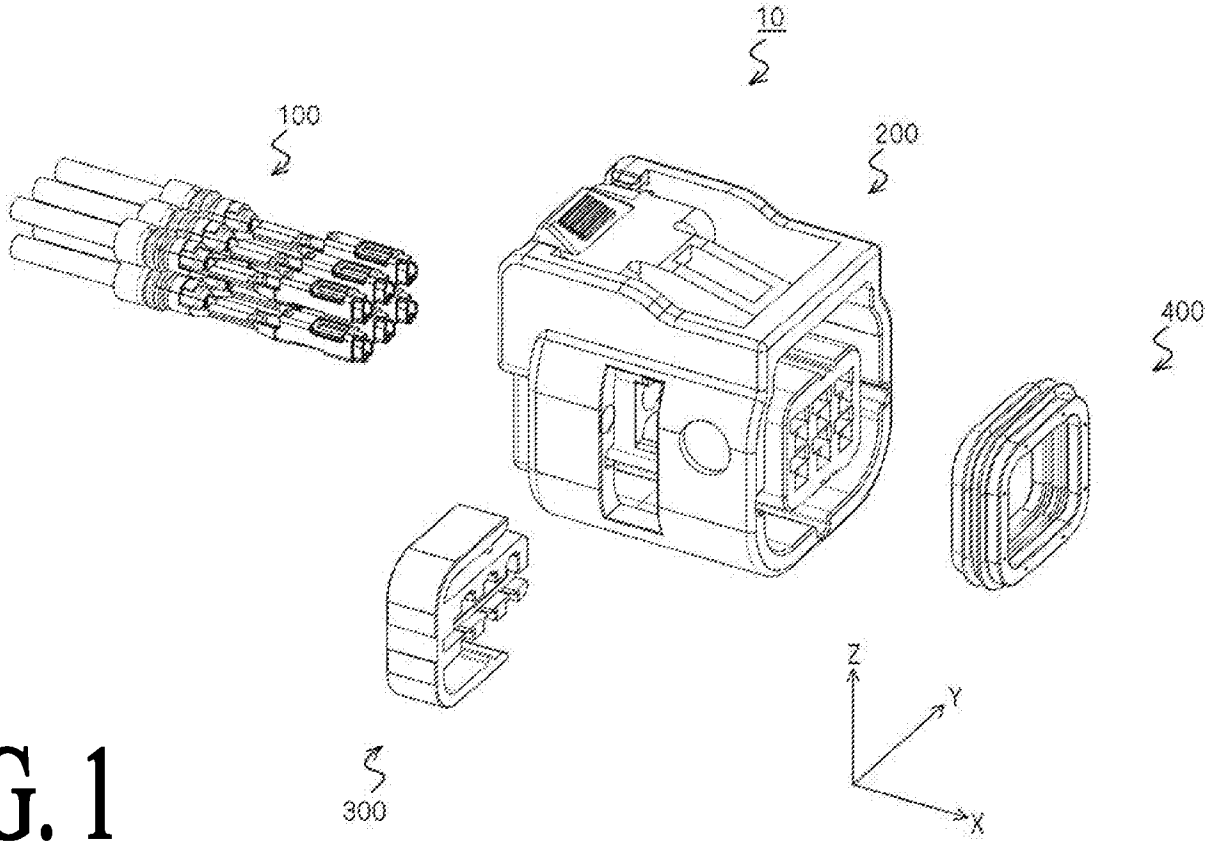
FIG. 1 is an exploded perspective view of a connector assembly of an embodiment.

FIG. 1 is an exploded perspective view of the connector assembly 10. As illustrated in FIG. 1, the connector assembly 10 includes a terminal 100, a housing 200, a retainer 300, and a waterproof seal 400. Further, in the following description, a direction that the terminal 100 extends (that is, a direction of inserting the terminal 100 into the housing 200) will be called a length direction X, a direction perpendicular to the length direction X and facing backward of the sheet in FIG. 1 will be called a width direction Y, and a direction perpendicular both to the length direction X and the width direction Y will be called a height direction Z. In addition, in the following description, when viewed from a side opposite to the direction of inserting the terminal 100 into the housing 200 of the length direction X (that is, an insertion direction of a mating connector connected to the connector assembly 10) (when viewed from the right side of the sheet in FIG. 1), the upper side is considered as an upper direction, the lower side as a lower direction, the left side as a left direction (the forward direction of the sheet of FIG. 1), and the right side (the backward direction of the sheet of FIG. 1) as a right direction.

First, the terminal 100 will be described with reference to FIG. 2. Further, FIG. 2A is a perspective view of the terminal 100 of the connector assembly 10 in this embodiment. FIG. 2B is a top view of the terminal 100 of FIG. 2A. FIG. 2C is a left side view when the terminal 100 of FIG. 2A is viewed from the left side. FIG. 2D is a bottom view of the terminal 100 of FIG. 2A. FIG. 2E is a front view of the terminal 100 of FIG. 2A. FIG. 2F is a cross-sectional view taken along line F-F in FIG. 2E.

The terminal 100 is formed to be bent backward after punching one metal plate sheet. The terminal 100 includes a box portion 110 which is vertically or horizontally asymmetrical in at least part of the cross-sectional shape to store a contact (not illustrated) of the mating connector, a crimping portion 120 which grips a lead wire 180, and a transition portion 130 which connects the box portion 110 and the crimping portion 120 and has a cross-sectional shape smaller than that of the box portion 110. Further, the crimping portion 120 and the transition portion 130 are formed in the rear portion in an insertion direction of the box portion 110 of the terminal 100.

The box portion 110 includes a top plate 111, a bottom plate 112, a left plate 113, and a right plate 114. The top plate 111, the bottom plate 112, the left plate 113, and the right plate 114 are made in a cylindrical shape and a box shape to form a contact insertion hole 115 which stores the contact of the mating connector. The cross-sectional shape in a plane perpendicular to the length direction X (or a direction to insert the contact of the mating connector into the contact insertion hole 115) of the box portion 110 is almost a rectangular shape of which the height is $H_{box}$. Further, there is provided a projection which is formed in one surface of the box portion 110 to protrude toward the outside. Further, in this embodiment, there is formed a projection 116 in the upper surface of the top plate 111 to protrude upward. On the contrary, a surface facing the surface where the projection 116 is provided, that is a lower surface 112*a* of the bottom plate 112 is formed flat in this embodiment. Therefore, the cross-sectional shape of the box portion 110 in a portion where at least the projection 116 is formed is vertically asymmetrical. Herein, the height from the lower surface 112*a* of the bottom plate 112 up to the tip end of the projection 116 is set to $H_{protrusion}$. Further, the upper surface of the top plate 111 may be formed in a flat shape by forming the projection in the bottom plate 112. Alternatively, the surface on the outside of one of the facing side plates may be formed in a flat shape by forming the projection in any one of the left plate 113 and the right plate 114.

In an upper surface 112*b* of the bottom plate 112, there is formed a contact piece 117 which extends backward or upward in the contact insertion hole 115. When the contact of the mating connector is inserted into the contact insertion hole 115, the contact piece 117 can abut on the lower surface of the contact of the mating connector and electrically connected thereto.

The crimping portion 120 includes a coating gripping portion 121 which grips a coating portion of the lead wire 180 and a conductor gripping portion 122 which grips the conductor portion of the lead wire 180. Further, in this embodiment, a conductor waterproof seal 190 is attached surrounding the coating of the lead wire 180. The coating gripping portion 121 is crimped to surround the conductor waterproof seal 190. The conductor gripping portion 122 includes a bottom plate 122*a* and gripping pieces 122*b* and 122*c* which extend upward in both right and left sides therefrom. The conductor portion of the lead wire 180 is crimped between the gripping pieces 122*b* and 122*c* and the bottom plate 122*a* by caulking the gripping pieces 122*b* and 122*c* toward the bottom plate 122*a*, and electrically connected thereto.

The transition portion 130 is connected to the box portion 110 and the crimping portion 120. The transition portion 130 includes the bottom plate 112 (to continue to the bottom plate 112 of the box portion 110), a left surface 132 which is erected from the left side of the bottom plate 112, and a right surface 133 which is erected from the right side of the bottom plate 112. The bottom plate 112 of the transition portion 130 is further jointed to the bottom plate 122*a* of the conductor gripping portion 122 of the crimping portion 120. In addition, the left surface 132 of the transition portion 130 is jointed to the left plate 113 of the box portion 110. The right surface 133 of the transition portion 130 is jointed to the right plate 114 of the box portion 110. Further, the heights of the right surface 133 and the left surface 132 of the transition portion 130 are lower than those of the right plate 114 and the left plate 113 of the box portion 110, and are formed to be $H_{transition}$. With this configuration, the cross-sectional shape of the transition portion 130 becomes smaller than the cross-sectional shape of the box portion 110 (a low height shape in this embodiment). In addition, the rear end portion of the left plate 113 of the box portion 110 which is not connected to the left surface 132 of the transition portion 130, the rear end portion of the right plate 114 of the box portion 110 which is not connected to the right surface 133 of the transition portion 130, and the rear end portion of the top plate 111 of the box portion 110 form a rear end surface 118.

Figure 3B:
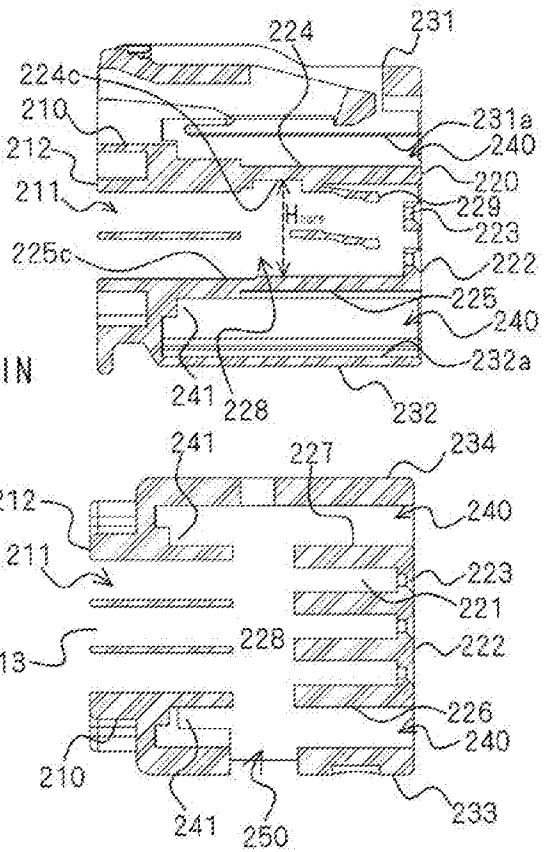
FIG. 3B is a cross-sectional view when the housing of FIG. 3A is cut in an X-Z plane.
Figure 3C:
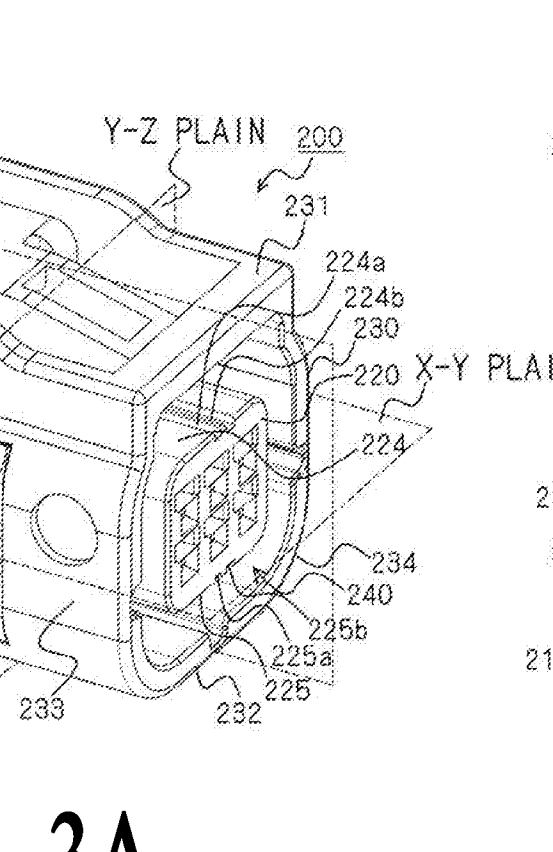
FIG. 3C is a cross-sectional view when the housing of FIG. 3A is cut in an X-Y plane.
Figure 3A:
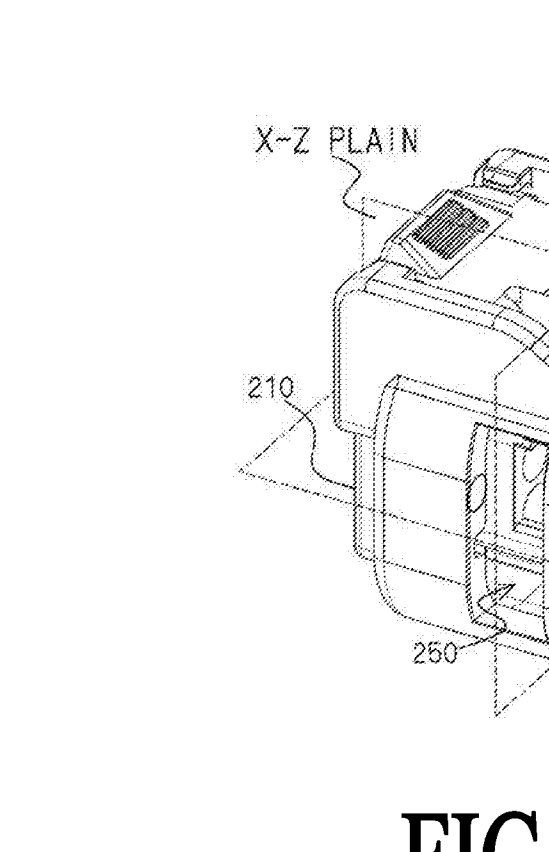
FIG. 3A is a perspective view of a housing of the connector assembly of this embodiment.

Next, the housing 200 will be described with reference to FIG. 3. FIG. 3A is a perspective view of the housing 200 of the connector assembly 10 of this embodiment. FIG. 3B is a cross-sectional view when the housing 200 of FIG. 3A is cut in an X-Z plane. FIG. 3C is a cross-sectional view when the housing 200 of FIG. 3A is cut in an X-Y plane. As illustrated in FIGS. 3A to 3C, the housing 200 includes a base 210 which has a predetermined length in the length direction X and is formed in a rectangular shape comparatively large in height direction Z and the width direction Y, a core 220 which extends from the base 210 toward the front in the length direction X, and an outer shell 230 which faces from the outer edge portion of the base 210 toward the front in the length direction X and extends to surround the core 220. The outer shell 230 includes a shell top surface 231, a shell bottom surface 232, a shell left surface 233, and a shell right surface 234. These components are directly connected to the base 210. The outer shell 230 and the core 220 are not directly connected but connected through the base 210. In addition, there is formed a mating connector inserting slot 240 between the outer shell 230 and the core 220 to be stored in the housing of the mating connector (not illustrated) to surround the core 220. The mating connector inserting slot reaches the base 210, and separates the outer shell 230 and the core 220.

In the base 210 of the housing 200 and in the rear portion of the length direction X of the core 220 connected to the base 210, a plurality of crimping portion storing paths 211 are formed in an insertion direction of the retainer described below such that the crimping portion storing paths for storing the crimping portion 120 of the terminal 100 extend in the length direction X. The crimping portion storing path 211 is formed almost in the same straight shape as a box portion storing path described below. Further, in FIGS. 3A to 3C, there are six crimping portion storing paths 211 in total: three in the width direction Y, and two in the height direction Z. Further, the number of these crimping portion storing paths 211 in the width direction Y and the number in the height direction Z are not limited to the example, but may be changed. The cross-sectional shape in the surface parallel to a Y-Z plane of each crimping portion storing path 211 is made in a shape and a size to store the crimping portion 120 of the terminal 100 and the conductor waterproof seal 190 which is attached to the crimping portion. In this embodiment, the cross section is formed in a circular shape slightly smaller than the outer diameter of the conductor waterproof seal 190. The rear surface of the base 210 in the X direction forms a rear end surface 212. A portion where the crimping portion storing path 211 reaches the rear end surface 212 becomes a terminal insertion opening 213 to insert the terminal 100 into the crimping portion storing path 211.

In the core 220, there is formed a plurality of box portion storing paths 221 to store the box portion 110 of the terminal 100 on the same straight line as the crimping portion storing path 211 in the front portion in the X direction. The cross-sectional shape in the surface parallel to the Y-Z plane of each box portion storing path 221 may be formed in any shape as long as the box portion 110 of the terminal 100 can be stored. In this embodiment, the cross section is formed almost in a rectangular shape of which the size in the height direction Z is slightly larger than that in the width direction Y. The front surface of the core 220 in the length direction X becomes a front end surface 222. The box portion storing path 221 reaches the front end surface 222, and forms a male terminal insertion opening 223. The male terminal insertion opening 223 has almost the same size or shape as that of the inner space surrounded by the top plate 111, the bottom plate 112, the left plate 113, and the right plate 114 of the box portion 110 of the terminal 100. Further, in each box portion storing path 221, there is provided a locking piece 229 which protrudes from the top plate forming the box portion storing path 221 toward the front side in the box portion storing path 221. The locking piece 229 locks the projection 116 of the box portion 110 when the box portion 110 of the terminal 100 is completely inserted into the box portion storing path 221.

A retainer insertion slot 250 is formed long in the height direction Z in almost the center portion in the length direction X of the shell left surface 233 of the outer shell 230 of the housing 200. The retainer insertion slot 250 extends in a direction perpendicular to the extending direction of the crimping portion storing path 211 and the box portion storing path 221 (that is, toward the width direction Y in this embodiment). The retainer insertion slot 250 passes through the mating connector inserting slot 240 on a side near the shell left surface 233. Further, the retainer insertion slot 250 passes through a core left surface 226, the crimping portion storing path 211 and the box portion storing path 221 in the core 220, and a core right surface 227. The retainer insertion slot 250 reaches the mating connector inserting slot 240 on a side near the shell right surface 234. The retainer insertion slot 250 intersects with the extension direction of the box portion storing path 221 and the crimping portion storing path 211 while separating the box portion storing path 221 and the crimping portion storing path 211. Further, as illustrated in FIGS. 3B and 3C, the core left surface 226 and the core right surface 227 of the core 220 is penetrated by the retainer insertion slot 250. A core upper surface 224 and a core lower surface 225 of the core 220 are not penetrated by the retainer insertion slot 250, but are jointed until reaching the base 210. Further, in the core 220, the portions of the crimping portion storing path 211 and the box portion storing path 221 penetrated by the retainer insertion slot 250 form a main body storing portion 228 where the main body of the retainer 300 described below is stored.

Further, in the core upper surface 224, a first locking groove 224*a* and a second locking groove 224*b* are formed. Similarly, in the core lower surface 225, a first locking groove 225*a* and a second locking groove 225*b* are formed. The first locking grooves 224*a* and 225*a* in this embodiment are formed on a side near the shell left surface 233 where the retainer insertion slot 250 is formed (that is, on a side near the core left surface 226). The second locking grooves 224*b* and 225*b* are formed on a side away from the shell left surface 233 (that is, on a side near the core right surface 227).

Next, the retainer 300 will be described with reference to FIG. 4. FIG. 4A is a perspective view of the retainer 300 of the connector assembly 10 of this embodiment. FIG. 4B is a front view of the retainer 300 of FIG. 4A. FIG. 4C is a rear view of the retainer 300 of FIG. 4A. FIG. 4D is an enlarged view of D portion of FIG. 4B. FIG. 4E is an enlarged view of E portion of FIG. 4B.

The retainer 300 is inserted into the retainer insertion slot 250, and takes a temporary locking position and a final locking position described below. The retainer 300 includes a main body 310 which is long in the width direction Y, an upper arm 320 which extends from the upper end of a left end portion 311 of the width direction Y of the main body 310 to the upper side, and extends toward the width direction Y (right direction), and a lower arm 330 which extends from the lower end of the left end portion 311 of the width direction Y of the main body 310 to the lower side, and extends toward the width direction Y (right direction). The upper arm 320 is located between the core upper surface 224 of the core 220 and a lower surface 231*a* of the shell top surface 231 of the outer shell 230 when the retainer 300 is inserted into the retainer insertion slot 250 of the housing 200, and the main body 310 is inserted into the main body storing portion 228 of the core 220. In addition, the lower arm 330 is located between the core lower surface 225 of the core 220 and an upper surface 232*a* of the shell bottom surface 232 of the outer shell 230 when the retainer 300 is inserted into the retainer insertion slot 250, and the main body 310 is inserted into the main body storing portion 228 of the core 220.

In an upper arm lower surface 321 of the upper arm 320 of the retainer 300, there is provided an upper locking projection 322 which protrudes toward the lower side in the height direction Z. In addition, in a lower arm upper surface 331 of the lower arm 330, there is provided a lower locking projection 332 which protrudes toward the upper side of the height direction Z. The upper locking projection 322 is locked to any one of the first locking groove 224*a* and the second locking groove 224*b* of the core upper surface 224. On the other hand, the lower locking projection 332 is locked to any one of the first locking groove 225*a* and the second locking groove 225*b* of the core lower surface 225.

Figure 7A:
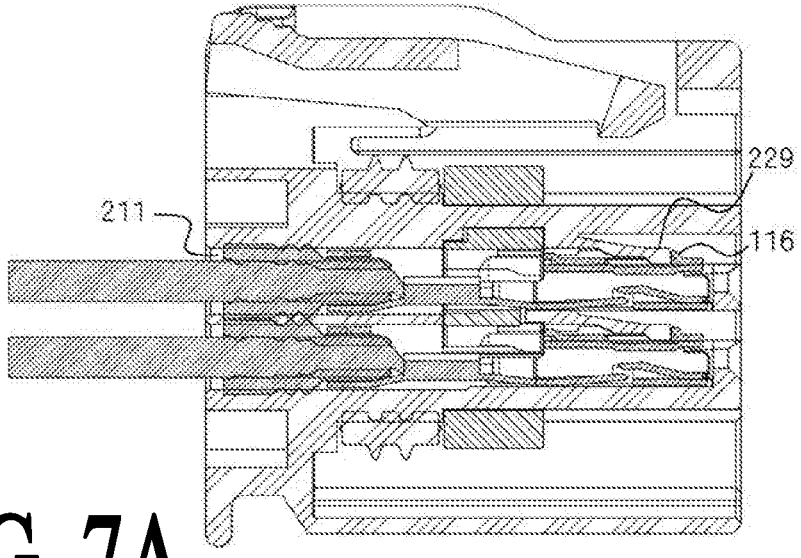
FIG. 7A is a cross-sectional view of the retainer taken in the X-Z plane in FIG. 3A in a case where the retainer of the connector assembly in this embodiment is at the temporary locking position, and the terminal is mounted.
Figure 7B:
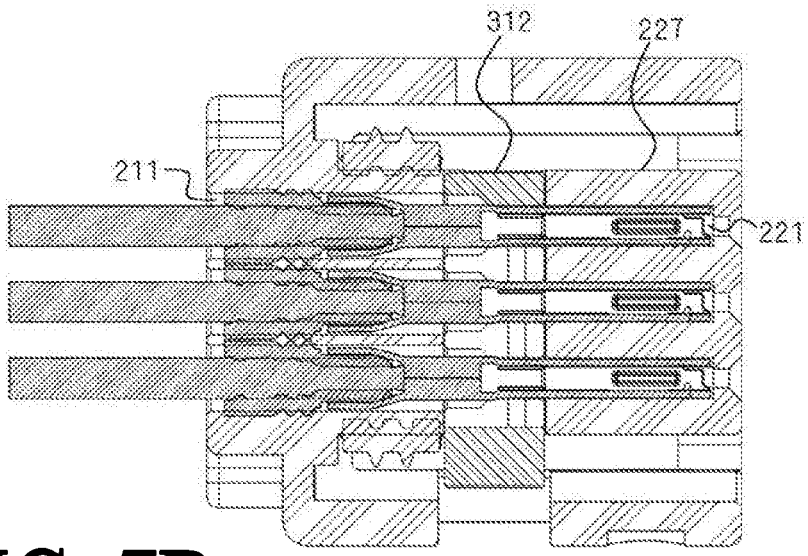
FIG. 7B is a cross-sectional view of the retainer taken in the X-Y plane in FIG. 3A in a case where the retainer of the connector assembly in this embodiment is at the temporary locking position, and the terminal is mounted.

The length (width) of the main body 310 in the width direction Y is formed to be a length such that a right end portion 312 of the main body 310 and the core right surface 227 are aligned on almost the same plane at a "temporary locking position" at which the main body 310 is inserted into the main body storing portion 228 of the core 220 of the housing 200 from the retainer insertion slot 250, the upper locking projection 322 of the upper arm 320 is locked to the first locking groove 224*a* of the core upper surface 224, and the lower locking projection 332 of the lower arm 330 is locked to the first locking groove 225*a* of the core lower surface 225 (see FIG. 7B).

A height $H_{body}$ of the main body 310 in the height direction Z is slightly higher by a height $H_{transition}$ of the transition portion 130 of the terminal 100 than a distance $H_{core}$ (see FIG. 3B) from an upper surface 225*c* of the core lower surface 225 to a lower surface 224*c* in the main body storing portion 228 of the core upper surface 224 (see FIG. 2F). In other words, $H_{core} \geq H_{body} + H_{transition}$ is satisfied.

In the main body 310, there are formed a plurality of box portion openings 313 through which the box portion 110 of the terminal 100 is inserted, and a plurality of transition portion openings 314 which is connected to the box portion opening 313 in the width direction in a case where the retainer 300 is at a predetermined position (temporary locking position) in the retainer insertion slot 250. In this embodiment, in the main body 310 of the retainer 300, the box portion opening 313 and the transition portion opening 314 which are formed in the base 210 and the core 220 of the housing 200 are formed by the same number as the number of the box portion storing paths 221 and the crimping portion storing paths 211 in the insertion direction (the width direction Y) of the retainer toward the insertion direction (the width direction Y) of the retainer. Each box portion opening 313 is connected to the transition portion opening to receive the transition portion 130 of the adjacent terminal 100. Specifically, in the terminal 100 assembled to the connector assembly 10, the same number (that is, three box portion openings 313 (313*a*, 313*b*, and 313*c*) and three transition portion openings 314 (314*a*, 313*b*, and 313*c*)) of openings are formed on the same straight line along the width direction Y. Further, each box portion opening 313 is formed at a position to be one the same straight line with the box portion storing path 221 of the core 220 in the length direction X when the main body 310 of the retainer 300 is inserted into the main body storing portion 228 of the core 220 from the retainer insertion slot 250, and the retainer 300 is at the temporary locking position.

The box portion opening 313 and the transition portion opening 314 through which one terminal 100 is received are connected to the box portion opening 313 and the transition portion opening 314 through which another terminal 100 adjacent in the width direction Y is received. Therefore, in this embodiment, the box portion opening 313*a* is connected to the transition portion opening 314*a* for the same terminal which the opening receives. The transition portion opening 314*a* is connected to the box portion opening 313*b* through which another adjacent terminal 100 is received. The box portion opening 313*b* is connected to the transition portion opening 314*b* through which the same terminal 100 is received. The transition portion opening 314*b* is connected to the box portion opening 313*c* through which still another adjacent terminal 100 is received. The box portion opening 313*c* is connected to the transition portion opening 314*c* through which the same terminal 100 is received.

Each box portion opening 313 is formed in a shape to prevent the inserting in a state where the terminal 100 is rotated from an appropriate position about the insertion axis (the length direction X) of the terminal 100 when the terminal 100 is inserted into the box portion storing path 221 of the housing 200 from the box portion opening 313 of the retainer 300. For example, the box portion opening 313 is formed in a shape corresponding to the cross-sectional shape of the vertically-asymmetric box portion 110 (or a shape corresponding to the cross-sectional shape of a horizontally-asymmetric box). In other words, in this embodiment, a height $H_{opening}$ of the box portion opening 313 is formed almost in a rectangular shape of which the height is the same as or slightly larger than the height $H_{box}$ of the box portion 110 of the terminal 100. While a bottom side 313L is formed in a flat shape, a cavity 313X is formed such that an upper side 313T is dented toward the upper side in the center portion. A height $H_{max}$ from the bottom side 313L to the cavity 313X of the upper side is almost the same as or larger than the height $H_{protrusion}$ of the portion of the box portion 110 of the terminal 100 where the projection 116 is formed.

In addition, the size (the size in the height direction Z) of each transition portion opening 314 in a direction perpendicular to the insertion direction (the width direction Y) of the retainer 300 is formed to be smaller than the size of the box portion opening 313. Specifically, a height $H_{min}$ of the transition portion opening 314 is smaller than the height $H_{box}$ of the box portion 110 of the terminal 100, and higher than the height $H_{transition}$ of the transition portion 130 of the terminal 100.

Further, in a lower surface 316 of the main body 310 of the retainer 300, there are formed the box portion openings 313*a* to 313*c*, and recessed portions 317*a* to 317*c* for the box portion at the same positions in the width direction Y (hereinafter, collectively referred to as a recessed portion 317 for the box portion). Each recessed portion 317 for the box portion is formed almost in the same shape as the upper side portion of the box portion opening 313. The recessed portion 317 includes an upper side 317T corresponding to the upper side 313T of the box portion opening 313 and a cavity 317X formed such that the upper side 317T is recessed toward the upper side in the center portion.

Herein, when the main body 310 of the retainer 300 is inserted into the main body storing portion 228 of the core 220 from the retainer insertion slot 250, and the retainer 300 is at the temporary locking position, the lower arm 330 of the retainer is located between the core lower surface 225 of the core 220 and the upper surface 232*a* of the shell bottom surface 232 of the outer shell 230. Therefore, the lower surface 316 of the main body 310 faces the upper surface 225*c* of the core lower surface 225. At this time, the height from the upper surface 225*c* of the core lower surface 225 to the upper side 317T of the recessed portion 317 for the box portion is almost the same as the height $H_{opening}$ of the box portion opening 313. In addition, the height from the upper surface 225*c* of the core lower surface 225 to the cavity 317X of the recessed portion 317 for the box portion is almost the same as the height $H_{max}$ from the bottom side 313L of the box portion opening 313 to the cavity 313X. In addition, in the temporary locking position, the height from the upper surface 225*c* of the core lower surface 225 to the lower surface 316 of the main body 310 of the retainer 300 is almost the same as the height $H_{min}$ of the transition portion opening 314. Further, in this embodiment, a groove to receive the lower portion of the box portion 110 of the terminal 100 (that is, the lower portion of the left plate 113, the lower portion of the right plate 114, and the bottom plate 112) may be formed in the upper surface 225*c* of the core lower surface 225 (see FIGS. 6 and 7).

Figure 5:
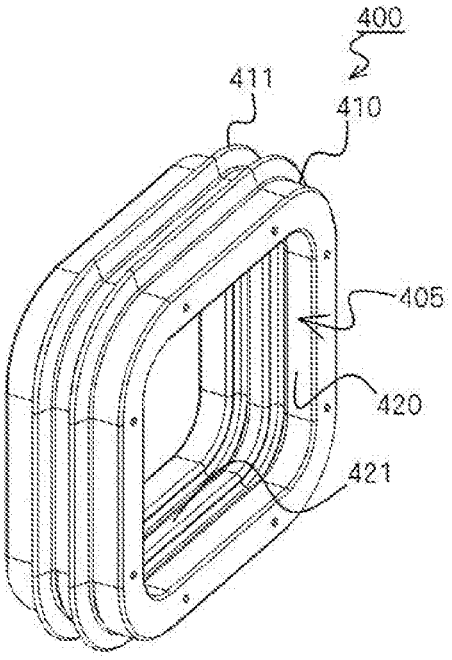
FIG. 5 is a perspective view of a waterproof seal of the connector assembly of this embodiment.

Next, the waterproof seal 400 will be described with reference to FIG. 5. Further, FIG. 5 is a perspective view of the waterproof seal 400 of the connector assembly 10 of this embodiment. The waterproof seal 400 is formed in a shape which comes in waterproof contact with the inner walls of the shell top surface 231, the shell bottom surface 232, the shell left surface 233, and the shell right surface 234 of which the outer shapes form the outer shell 230 of the housing 200. The waterproof seal 400 includes an opening 405 for the insertion of the core 220 of the housing 200. The waterproof seal 400 is formed of an elastic material. Further, in an outer surface 410 of the waterproof seal 400, a plurality of projecting portions 411 are formed along a direction perpendicular to the length direction X (that is, the width direction Y and the height direction Z). In addition, in an inner surface 420 of the waterproof seal 400, a plurality of groove portions 421 are formed along a direction perpendicular to the length direction X (that is, the width direction Y and the height direction Z). The waterproof seal 400 is inserted to a slot innermost portion 241 of the mating connector inserting slot 240 of the housing 200 at the time of assembling the connector assembly 10.

Next, an assembling method of the connector assembly 10 will be described. As illustrated in FIG. 1, first, the waterproof seal 400 is inserted into the mating connector inserting slot 240 in a direction opposite to the length direction X. The waterproof seal 400 is disposed in the slot innermost portion 241. At this time, the waterproof seal 400 comes in tight contact with the surrounding of the core 220 by the plurality of groove portions 421 formed in the inner surface 420 of the waterproof seal 400. Next, the retainer 300 is inserted into the retainer insertion slot 250 of the housing 200. The terminal 100 is mounted in the housing 200.

A method of inserting the retainer 300 into the retainer insertion slot 250 and mounting the terminal 100 will be described with reference to FIGS. 6 and 7. Further, FIG. 6A is a cross-sectional view taken along the Y-Z plane in FIG. 3A in a case where the retainer 300 of the connector assembly 10 in this embodiment is at the temporary locking position. FIG. 6B is an enlarged view of B portion in FIG. 6A. FIG. 6C is a front view in a case where the retainer 300 of the connector assembly 10 in this embodiment is at the temporary locking position. Further, FIG. 7A is a cross-sectional view taken along the X-Z plane in FIG. 3A when the retainer 300 of the connector assembly 10 in this embodiment is at the temporary locking position, and the terminal 100 is mounted. FIG. 7B is a cross-sectional view taken along the X-Y plane in FIG. 3A when the retainer 300 of the connector assembly 10 in this embodiment is at the temporary locking position, and the terminal 100 is mounted.

As illustrated in FIGS. 6A and 6B, when the retainer 300 is inserted into the retainer insertion slot 250, the main body 310 of the retainer 300 enters the main body storing portion 228 of the core 220. In addition, the upper arm 320 of the retainer 300 is inserted between the lower surface 231*a* of the shell top surface 231 of the housing 200 and the core upper surface 224 of the core 220. Further, the lower arm 330 of the retainer 300 is inserted between the upper surface 232*a* of the shell bottom surface 232 of the housing 200 and the core lower surface 225 of the core 220. When the retainer 300 is inserted into the retainer insertion slot 250, and moves in the width direction Y, the upper locking projection 322 of the upper arm 320 of the retainer 300 is locked to the first locking groove 224*a* which is formed in the core upper surface 224 of the core 220. The lower locking projection 332 of the lower arm 330 of the retainer 300 is locked to the first locking groove 225*a* which is formed in the core lower surface 225 of the core 220. At this time, the retainer 300 is at the temporary locking position.

At the temporary locking position, the box portion opening 313 and the recessed portion 317 for the box portion which are formed in the main body 310 of the retainer 300 are aligned on a straight line in the length direction X together with the crimping portion storing path 211 and the box portion storing path 221 of the housing 200. At the temporary locking position, the terminal 100 crimping and connecting the lead wire 180 to the crimping portion 120 is inserted into the crimping portion storing path 211 from the terminal insertion opening 213 of the base 210 of the housing 200. Since the shape of the crimping portion storing path 211 is a circular shape larger than the outer shape of the box portion 110 of the terminal 100, the box portion 110 of the terminal 100 passes through the crimping portion storing path 211 without any trouble, and reaches the box portion opening 313 or the recessed portion 317 for the box portion of the main body 310 of the retainer 300.

At this time, when the terminal 100 takes an appropriate posture about the insertion axis (the length direction X), that is, in a case where the terminal 100 is inserted in a direction where the projection 116 of the box portion 110 is located on the upper side, and the bottom plate 112 is located on the lower side, the upper side 313T of the box portion opening 313 of the main body 310 of the retainer 300 is located on the upper side of the top plate 111 of the box portion 110. The cavity 313X of the box portion opening 313 is located on the upper side of the projection 116 of the box portion 110. Therefore, the box portion opening 313 of the retainer 300 is allowed to enter in the length direction X of the box portion 110. Next, when the terminal 100 is moved in the length direction X, the box portion 110 is inserted into the box portion storing path 221 of the core 220. The projection 116 of the box portion 110 is locked to the locking piece 229 which protrudes into the box portion storing path 221 (FIG. 7A). In other words, the terminal 100 can be inserted into the box portion storing path 221 from the crimping portion storing path 211 through the box portion opening 313.

Similarly, when the terminal 100 is in a correct direction, that is, in a case where the terminal 100 is inserted into the crimping portion storing path 211 located in the lower portion in a direction where the projection 116 of the box portion 110 is located on the upper side and the bottom plate 112 is located on the lower side, the upper side 317T of the recessed portion 317 for the box portion of the main body 310 of the retainer 300 is located on the upper side of the top plate 111 of the box portion 110. The cavity 317X of the recessed portion 317 for the box portion is located on the upper side of the projection 116 of the box portion 110. Therefore, the recessed portion 317 for the box portion of the retainer 300 is allowed to enter in the length direction X of the box portion 110. Next, when the terminal 100 is moved in the length direction X, the box portion 110 is inserted into the box portion storing path 221 of the core 220. The projection 116 of the box portion 110 is locked to the locking piece 229 which protrudes into the box portion storing path 221 (FIG. 7A).

Figure 8A:
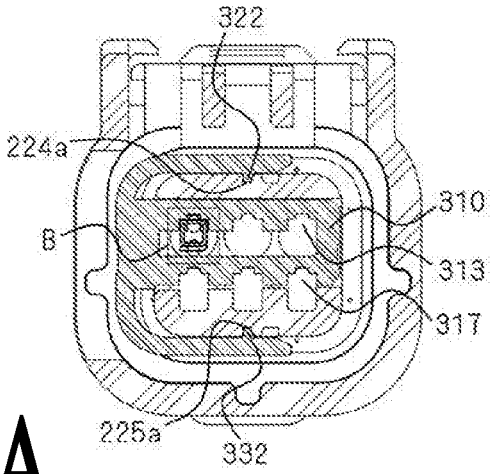
FIG. 8A is a cross-sectional view of the retainer taken in the Y-Z plane in FIG. 3A in a case where the retainer of the connector assembly in this embodiment is at the temporary locking position, and the terminal is inserted in a vertically-reversed direction.
Figure 8B:
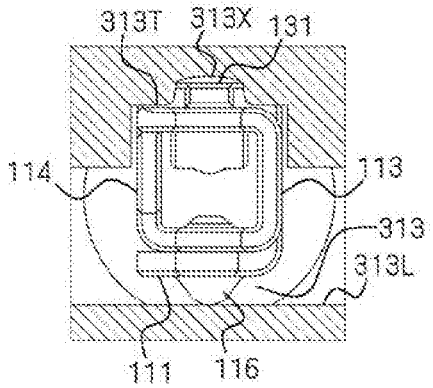
FIG. 8B is an enlarged view of B portion in FIG. 8A.

On the other hand, the description will be given with reference to FIG. 8 about a case where the terminal 100 is erroneously inserted in a state where the terminal 100 is rotated about the insertion axis (the axis in the same direction as the length direction X) from the appropriate position. Further, FIG. 8A is a cross-sectional view taken along the Y-Z plane in FIG. 3A in a case where the retainer 300 of the connector assembly 10 in this embodiment is at the temporary locking position, and the terminal 100 is inserted in a vertically-reversed direction. FIG. 8B is an enlarged view of B portion in FIG. 8A. The terminal 100 is inserted into the crimping portion storing path 211 from the base 210 of the housing 200 in a state where the retainer 300 is at the temporary locking position and the terminal 100 is in a vertically-reversed direction (that is, the projection 116 of the box portion 110 is on the lower side, and the bottom plate 112 is on the upper side). Then, since the shape of the crimping portion storing path 211 is a circular shape larger than the outer shape of the box portion 110 of the terminal 100, the box portion 110 of the terminal 100 passes through the crimping portion storing path 211 without any trouble, and reaches the box portion opening 313 or the recessed portion 317 for the box portion of the main body 310 of the retainer 300.

However, even when the terminal 100 is moved in the length direction X further more in this state, the entering to the box portion opening 313 of the vertically-reversed box portion 110 is prevented since the shape of the box portion 110 of the terminal 100 and the shape of the box portion opening 313 of the main body of the retainer 300 do not correspond to each other. Specifically, the entering of both side portion except the center portion of the bottom plate 112 of the box portion 110 of the terminal 100, the lower portion of the left plate 113 (located on the upper side in FIG. 8B), and the lower portion of the right plate 114 (located on the upper side in FIG. 8B) is hindered by the upper side 313T of the box portion opening 313. At this time, the projection 116 of the box portion 110 is located on the upper surface of the bottom side 313L of the box portion opening 313 of the retainer 300.

In addition, even if the bottom plate 112 of the box portion 110 is inserted into the box portion opening 313 at a position lower than the upper side 313T of the box portion opening 313, the entire box portion 110 is located on the lower side by that much. As a result, the projection 116 is stopped at the bottom side 313L of the box portion opening 313 of the main body 310 of the retainer 300. The entering in the length direction X of the box portion 110 is hindered.

Similarly, in a case where the terminal 100 is inserted into the crimping portion storing path 211 located in the lower portion in a vertically-reversed direction, and reaches the recessed portion 317 for the box portion of the retainer 300, the entering to the recessed portion 317 for the box portion of the vertically-reversed box portion 110 is prevented since the shape of the box portion 110 does not correspond to the shape formed by the recessed portion 317 for the box portion of the main body of the retainer 300 and the upper surface 225*c* of the core lower surface 225 of the core 220. Specifically, the entering to the recessed portion 317 for the box portion of both side portion except the center portion of the bottom plate 112 of the box portion 110 of the terminal 100, the lower portion of the left plate 113, and the lower portion of the right plate 114 is hindered by the upper side 317T of the recessed portion 317 for the box portion. At this time, the projection 116 of the box portion 110 is located on the upper surface of the upper surface 225*c* of the core lower surface 225 of the core 220.

In addition, even if the bottom plate 112 of the box portion 110 is inserted into the recessed portion 317 for the box portion at a position lower than the upper side 317T of the recessed portion 317, the box portion 110 is located on the lower side by that much. As a result, the projection 116 is stopped at the upper surface 225*c* of the core lower surface 225 of the core 220. The entering in the length direction X of the box portion 110 is hindered.

Further, the above description has been given about a case where the erroneous insertion of the terminal 100 is prevented when the terminal 100 is inserted into the crimping portion storing path 211 in a vertically-reversed direction (that is, a state of being rotated by 180 degrees), and reaches the box portion opening 313 of the retainer 300 and the recessed portion 317 for the box portion. In the present invention, the shapes of the box portion 110 of the terminal 100 and the box portion opening 313 and the recessed portion 317 for the box portion of the retainer 300 are not matched even in a case where the terminal 100 is erroneously inserted in the state of being rotated at an angle other than 180 degrees about the insertion axis of the terminal 100 (for example, 90 degrees). The insertion into the box portion opening 313 of the box portion 110 and the recessed portion 317 for the box portion is prevented.

When the box portion 110 of the terminal 100 passes through the box portion opening 313 of the retainer 300 and the recessed portion 317 for the box portion in a correct direction, and is stored in the box portion storing path 221, the transition portion 130 is located in the lower portion of the box portion opening 313 and the lower portion of the recessed portion 317 for the box portion. With this configuration, the retainer 300 can be moved in the width direction Y further more. In a case where the box portion 110 is not completely stored in the box portion storing path 221, the left plate 113 of the box portion 110 exists in the box portion opening 313 and the recessed portion 317 for the box portion. At this time, even when the retainer 300 is moved in the width direction Y, the movement in the width direction Y is stopped by the left plate 113 of the box portion 110. With this configuration, it is possible to detect a half-insertion of the terminal 100 (that is, a state where the terminal 100 is not completely stored in the box portion storing path 221).

When the box portion 110 of the terminal 100 is completely inserted into the box portion storing path 221, the movement of the retainer 300 in the width direction Y is allowed. When the retainer 300 is moved in the width direction Y further more, the upper locking projection 322 of the upper arm 320 of the retainer 300 is released from the first locking groove 224*a* formed in the core upper surface 224 of the core 220 to move in the width direction Y, and is locked to the second locking groove 224*b*. Similarly, the lower locking projection 332 of the lower arm 330 of the retainer 300 is released from the first locking groove 225*a* formed in the core lower surface 225 of the core 220 to move in the width direction Y, and is locked to the second locking groove 225*b*. At this time, the retainer 300 is at the final locking position.

Figure 9A:
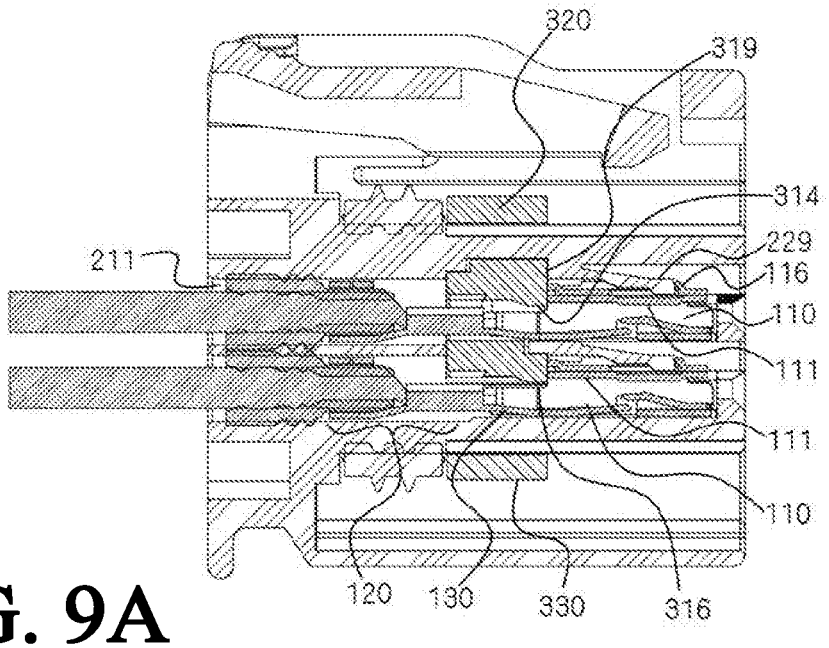
FIG. 9A is a cross-sectional view of the connector assembly in the X-Z plane of FIG. 3A when the retainer is at a final locking position.
Figure 9B:
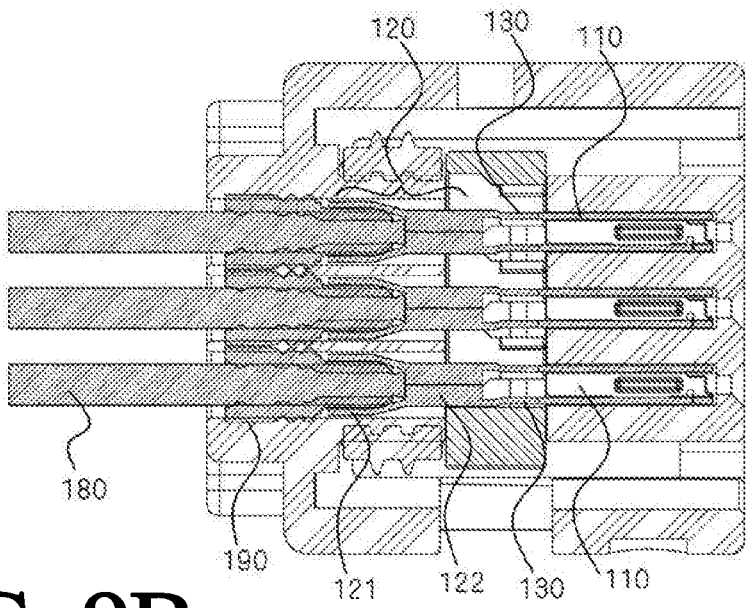
FIG. 9B is a cross-sectional view of the connector assembly in the X-Y plane of FIG. 3B when the retainer is at the final locking position.

FIG. 9A is a cross-sectional view of the connector assembly 10 in the X-Z plane of FIG. 3A when the retainer 300 is at the final locking position. FIG. 9B is a cross-sectional view in the X-Y plane of FIG. 3B. As same as described in FIG. 7, the box portion 110 of the terminal 100 is stored in the box portion storing path 221 of the core 220. In addition, the crimping portion 120 of the terminal 100 is stored in the crimping portion storing path 211 formed in the base 210 and the rear portion of the core 220. Further, part of the conductor gripping portion 122 of the crimping portion 120 and the transition portion 130 of the terminal 100 are stored on the lower side of the transition portion opening 314 of the retainer 300 or the lower surface 316 of the main body 310 which is adjacent to the recessed portion 317 for the box portion.

As illustrated in FIGS. 2F, 3B, 4B, 4D, and 9A, the height $H_{min}$ of the transition portion opening 314 is smaller than the height $H_{box}$ of the box portion 110 of the terminal 100. Therefore, a front surface 319 of the main body 310 of the retainer 300 comes into contact with the rear end surface 118 of the box portion 110 of the terminal 100. In addition, the height of the retainer 300 from the upper surface 225*c* of the core lower surface 225 up to the lower surface 316 of the main body 310 adjacent to the recessed portion 317 for the box portion (the distance of the core upper surface 224 which is obtained by subtracting the height $H_{body}$ of the main body 310 of the retainer 300 from the distance $H_{core}$ between the lower surface 224*c* in the main body storing portion 228 and the upper surface 225*c* of the core lower surface 225) is smaller than the height $H_{box}$ of the box portion 110 of the terminal 100. Therefore, the front surface 319 of the main body 310 of the retainer 300 comes into contact with the rear end surface 118 of the box portion 110 of the terminal 100. In other words, when the retainer 300 is at the final locking position, the transition portion 130 of the terminal 100 is stored in the transition portion opening 314 of the retainer 300. Therefore, even when the terminal 100 is pulled in the opposite direction to the length direction X in this state, the rear end surface 118 of the box portion 110 abuts on the front surface 319 of the main body 310 of the retainer 300. Thus, the movement to the rear side of the box portion 110 is prevented, and the box portion 110 is not removed. With this configuration, the terminal 100 is prevented from falling out from the housing 200.

Further, the above embodiment has been described about a case where the shape of the box portion 110 of the terminal 100 is almost a rectangular shape, the projection 116 is provided in the upper surface of the top plate 111 to protrude toward the upper side, and the lower surface 112*a* of the bottom plate 112 facing the top plate 111 is a flat shape. Further, the box portion opening 313 formed in the main body 310 of the retainer 300 has been described such that the upper side 313T is formed in a shape having the cavity 313X recessed toward the upper side in the center portion in correspondence with the shape of the box portion 110. The bottom side 313L is formed in a flat shape. However, the present invention is not limited to the above embodiments. The projection protruding toward the outer side may be provided in one surface of the box portion 110. A surface facing the surface where the projection may be provided is a flat shape. One side of the box portion opening of the retainer may be a concave shape to receive the projection, and the side facing the one side may be formed in a flat shape.

Further, at least a portion of the cross-sectional shape of the box portion of the terminal may be formed vertically or horizontally asymmetric. Any shape may be employed as long as the retainer includes the box portion opening shaped in correspondence with the cross-sectional shape of the vertically or horizontally asymmetric box and the transition portion opening which is connected to the box portion opening having a small size in a direction perpendicular to the insertion direction of the retainer than the box portion opening.

For example, FIG. 10 illustrates the terminal equipped with the box portion of a cross-sectional shape different from the above embodiment, and the box portion opening of the retainer receiving the terminal. The cross-sectional shape of a box portion 110A of the terminal illustrated in FIG. 10A is almost a rectangular shape. In the center portion of an upper surface 111A, there is formed a cavity 116A recessed toward the lower side. Further, the cavity 116A is formed all over the length direction X of the box portion 110A. In a box portion opening 313A of a retainer 300A, there is formed a projection 313AX protruding toward the lower side in the center of an upper side 313AT in correspondence with the outer shape of the box portion 110A.

Figure 10A:
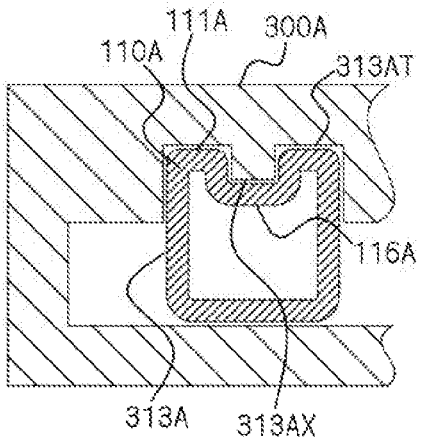
FIG. 10A is a diagram illustrating another example of the shape of a box portion and a box portion opening of the retainer.

As illustrated in FIG. 10A, in a case where the box portion 110A of the terminal is inserted into the housing 200 in a correct direction, the box portion opening 313A of the retainer 300A located at a temporary insertion position allows the box portion 110A to pass through. The passing box portion 110A is inserted into the box portion storing path 221 which is formed in the core 220 of the housing 200.

Figure 10B:
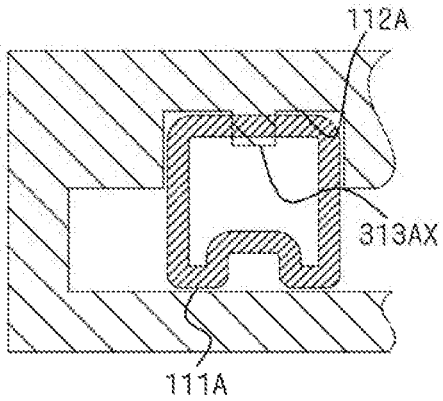
FIG. 10B is a diagram in a case where the box portion of FIG. 10A is inserted in a vertically-reversed direction.

On the other hand, as illustrated in FIG. 10B, when the box portion 110A of the terminal faces in a correct direction, for example, in a case where the box portion 110A is inserted into the housing 200 in a vertically-reversed direction, a bottom plate 112A of the box portion 110A abuts on the projection 313AX provided in the box portion opening 313A of the retainer 300A located at the temporary insertion position. The box portion 110A is not moved in the length direction X any more. The erroneous insertion in an incorrect direction of the terminal is prevented.

Figure 10C:
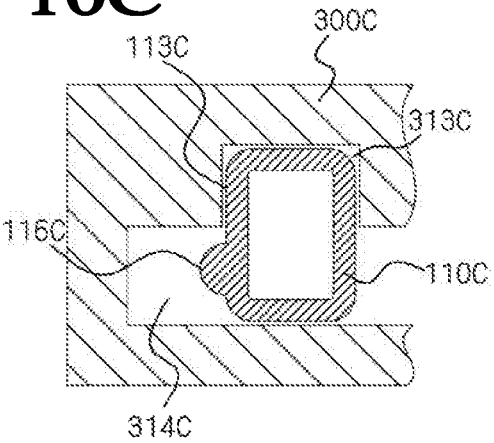
FIG. 10C is a diagram illustrating another example of the shape of the box portion and the box portion opening of the retainer.

The shapes of the box portions 110 and 110A of the above embodiment and FIGS. 10A and 10B are vertically asymmetric. However, the shape of the box portion of the terminal of the present invention may be horizontally asymmetric. For example, the cross-sectional shape of a box portion 110C of the terminal illustrated in FIG. 10C is almost a rectangular shape similarly to FIG. 10A. A projection 116C which protrudes toward the outer side (the opposite direction to the width direction Y) is formed in the lower portion of a left plate 113C. The upper portion of a box portion opening 313C of a retainer 300C is formed in a rectangular shape corresponding to the shape of the upper portion of the box portion 110C. The lower portion of the box portion opening 313C is connected to the adjacent transition portion opening 314C.

As illustrated in FIG. 10C, in a case where the box portion 110C of the terminal is inserted into the housing 200 in a correct direction, the box portion opening 313C and the transition portion opening 314C of the retainer 300C located at the temporary insertion position allow the box portion 110C and the projection 116C to pass therethrough. The passing box portion 110C is inserted into the box portion storing path 221 which is formed in the core 220 of the housing 200.

Figure 10D:
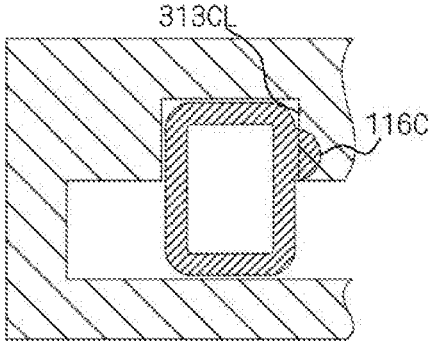
FIG. 10D is a diagram in a case where the box portion of FIG. 10B is inserted in a laterally-reversed direction.

On the other hand, as illustrated in FIG. 10D, in a case where the box portion 110C of the terminal is inserted into the housing 200 in an incorrect direction, for example, the box portion 110C is laterally reversed (a state of being rotated about the insertion axis of the terminal by 180 degrees), the projection 116C formed in the left plate 113C of the box portion 110C abuts on a wall surface (a right wall 313CL) which forms the box portion opening 313C of the retainer 300C located at the temporary insertion position. The box portion 110C is not moved in the length direction X any more. The erroneous insertion of the terminal in an incorrect direction is prevented.

Figure 10E:
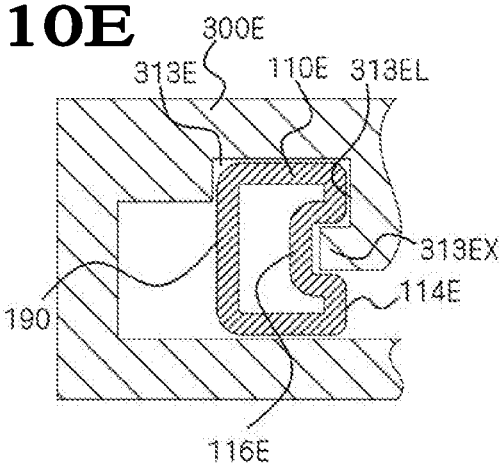
FIG. 10E is a diagram illustrating still another example of the shape of the box portion and the box portion opening of the retainer.

The cross-sectional shape of a box portion 110E of the terminal illustrated in FIG. 10E is almost a rectangular shape similarly to FIG. 10C. A cavity 116E which is recessed toward the inner side is formed in the center of a right plate 114E. Further, the cavity 116E is formed all over the length direction X of the box portion 110E. In a box portion opening 313E of a retainer 300E, there is formed a projection 313EX protruding toward the left direction of a right wall 313EL which forms the box portion opening 313E in correspondence with the outer shape of the box portion 110E.

As illustrated in FIG. 10E, in a case where the box portion 110E of the terminal is inserted into the housing 200 in a correct direction, the box portion opening 313E of the retainer 300E located at a temporary insertion position allows the box portion 110E to pass through. The box portion 110E passing therethrough is inserted into the box portion storing path 221 which is formed in the core 220 of the housing 200.

Figure 10F:
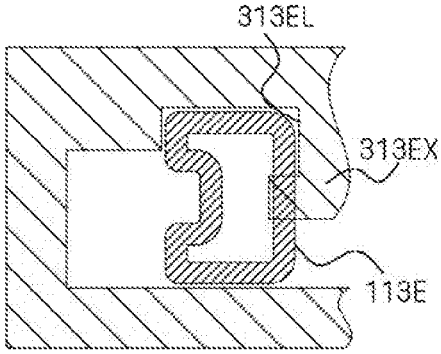
FIG. 10F is a diagram in a case where the box portion of FIG. 10E is inserted in a laterally-reversed direction.

On the other hand, as illustrated in FIG. 10F, in a case where the box portion 110E of the terminal is inserted into the housing 200 in an incorrect direction, for example, in a case where the box portion 110E is inserted into the housing 200 in a laterally-reversed direction (a state of being rotated about the insertion axis of the terminal by 180 degrees), a left plate 113E of the box portion 110E abuts on the projection 313EX of the right wall 313EL which forms the box portion opening 313E of the retainer 300E located at the temporary insertion position. The box portion 110E is not moved in the length direction X any more. The erroneous insertion in an incorrect direction of the terminal is prevented.

Further, the above example has been described about the main body of the retainers 300, 300A, 300C, and 300E such that three box portion openings (for example, 313) are formed on the upper side, and the recessed portion 317 for the box portion of the lower surface 316 of the main body is formed. However, the present invention is not limited to the above example. In the main body of the retainer 300, the box portion openings 313 and the transition portion openings may be formed in a direction perpendicular to the insertion direction of the retainer 300 (that is, the height direction Z) by the same number as the number of the crimping portion storing paths 211 and the box portion storing paths 221 in a direction perpendicular to the insertion direction of the retainer 300 (that is, the height direction Z) formed in the base 210 and the core 220 of the housing 200. Therefore, the recessed portion for the box portion may be not provided in the lower surface 316 of the retainer 300.

In addition, the above example has been described about the configuration that the retainer 300 is inserted into the retainer insertion slot 250 of the housing 200 in the width direction Y. However, the retainer insertion slot 250 of the housing 200 may be formed in the shell right surface 234 of the housing 200. The retainer 300 may be inserted into the retainer insertion slot in the opposite direction to the width direction Y from the right side of the housing 200. The retainer insertion slot 250 may be formed in any one of the shell top surface 231 and the shell bottom surface 232 of the housing 200. The retainer 300 may be inserted into the retainer insertion slot from any one of the upper side and the lower side of the housing 200.

In addition, the above example has been described about an example where the first locking grooves 224*a* and 225*a* and the second locking grooves 224*b* and 225*b* are formed in the core 220 of the housing 200 and, to face this configuration, the upper locking projection 322 is formed in the upper arm 320 of the retainer 300, and the lower locking projection 332 is formed in the lower arm 330 of the retainer 300. The first locking groove and the second locking groove may be formed in the upper arm 320 and the lower arm 330 of the retainer 300 and, to face this configuration, the locking projection may be formed in the shell top surface 231 and the shell bottom surface 232 of the core 220 or the outer shell 230 of the housing 200. Then, when the locking projection is locked to the first locking groove, the retainer 300 may be located at the temporary locking position. When the locking projection is locked at the second locking groove, the retainer 300 may be located at the final locking position.

What is claimed is:

1. A connector assembly, comprising:

a terminal which includes a box portion of which at least a cross-sectional shape is partially in a vertically or horizontally asymmetrical shape to receive a mating contact therein;

a housing which includes a box portion storing path to store the box portion and a slot formed to be perpendicular to an extending direction of the box portion storing path and at least one groove; and a retainer which includes a main body, an upper arm, and a box portion opening, and allows the box portion to pass through in a case where the retainer is inserted into the slot and is at a predetermined position in the slot, wherein the box portion opening is formed, when the terminal is inserted into the box portion storing path of the housing from the box portion opening of the retainer, to be a shape to prevent the insertion when the terminal is rotated about an insertion axis of the terminal from an appropriate position, wherein the upper arm extends away from the main body and has a projection protruding toward the main body, the projection being locked to the one groove when the retainer is at the predetermined position in the slot.

2. The connector assembly according to claim 1, wherein the box portion opening of the retainer is in a shape corresponding to a cross-sectional shape of the box portion of the vertically or horizontally asymmetric shape, and when the terminal is inserted into the box portion storing path of the housing from the box portion opening of the retainer, and when the terminal is rotated about the insertion axis of the terminal from an appropriate position, a cross-sectional shape of the box portion of the terminal and a shape of the box portion opening are not matched, and the insertion is prevented.

3. The connector assembly according to claim 1, wherein a projection protruding toward an outer side is provided in one surface of the box portion, and a surface facing the surface where the projection is provided is a flat shape, and one side of the box portion opening of the retainer is in a recessed shape to receive the projection, and a side facing the one side is in a flat shape.

4. The connector assembly according to claim 1, wherein the terminal includes a transition portion in a rear portion in an insertion direction of the terminal, the transition portion having a cross-sectional shape smaller than a cross-sectional shape of the box portion, the retainer includes a transition portion opening which is connected to the box portion opening, the transition portion opening in a direction perpendicular to an insertion direction of the retainer being smaller than the box portion opening, when the retainer is at the predetermined position in the slot at which the box portion opening and the box portion storing path are on a straight line, and the terminal takes an appropriate posture about the insertion axis, the terminal is able to be inserted into the box portion storing path from a crimping portion storing path through the box portion opening, and when the retainer is moved from the predetermined position to a final locking position, the transition portion of the terminal is stored in the transition portion opening, and the box portion is not removed.

5. The connector assembly according to claim 4, wherein, in the housing, a plurality of the box portion storing paths are disposed in the insertion direction of the retainer, in the retainer, the box portion opening and the transition portion opening are formed by the same number of box portion storing paths in the insertion direction of the retainer formed in the housing in the insertion direction, and each box portion opening is connected to the transition portion opening to receive the transition portion of an adjacent another terminal.

* * * * *